US012173985B1

(12) United States Patent
Wu

(10) Patent No.: US 12,173,985 B1
(45) Date of Patent: Dec. 24, 2024

(54) IMPACT-RESISTANT RED DOT SIGHT AND GUN

(71) Applicant: Xiaozhong Wu, Guangzhou (CN)

(72) Inventor: Xiaozhong Wu, Guangzhou (CN)

( * ) Notice: Subject to any disclaimer, the term of this patent is extended or adjusted under 35 U.S.C. 154(b) by 0 days.

(21) Appl. No.: 18/637,363

(22) Filed: Apr. 16, 2024

(51) Int. Cl.
*F41G 1/30* (2006.01)
*F41G 11/00* (2006.01)

(52) U.S. Cl.
CPC ..... *F41G 1/30* (2013.01); *F41G 11/001* (2013.01)

(58) Field of Classification Search
CPC ..... F41G 1/30; F41G 11/001
USPC ..... 42/113
See application file for complete search history.

(56) References Cited

U.S. PATENT DOCUMENTS

2022/0244016 A1* 8/2022 Reese ..... G02B 23/16
2022/0244020 A1* 8/2022 Morell ..... F41G 1/345
2022/0282953 A1* 9/2022 Lee ..... G02B 23/16
2023/0175813 A1* 6/2023 Sabaldan Elpedes .... F41G 3/08 42/113
2023/0332865 A1* 10/2023 Wells ..... G02B 23/16
2024/0011738 A1* 1/2024 White ..... F41G 11/001
2024/0027165 A1* 1/2024 York ..... H01M 50/247
2024/0093965 A1* 3/2024 Reese ..... G02B 23/16

* cited by examiner

*Primary Examiner* — Samir Abdosh

(57) ABSTRACT

The present disclosure relates to an impact-resistant red dot sight and a gun, which relate to the field of sights. The impact-resistant red dot sight comprises a cover, a lens holder, and a base, wherein the base can be mounted on the gun; and a light-emitting part is provided on the lens holder and can emit light to be reflected by a lens to achieve aiming. The impact-resistant red dot sight enables better protection of the lens and effectively reduces the risk of lens damage when the impact-resistant red dot sight falls off.

18 Claims, 2 Drawing Sheets

IMPACT-RESISTANT RED DOT SIGHT AND GUN

TECHNICAL FIELD

The present disclosure relates to the field of sights, and in particular to an impact-resistant red dot sight and a gun.

BACKGROUND ART

At present, many guns are equipped with a sight that allows for more accurate shooting of the guns. There are a great variety of sights, including red dot sights, and some red dot sights are removable from the guns. When the red dot sights are not needed, the red dot sights can be removed, and when the red dot sights are needed, the red dot sight can be mounted on the guns.

SUMMARY

The present disclosure is implemented by means of the following technical solutions.

In a first aspect, the present disclosure provides an impact-resistant red dot sight, comprising a cover, a lens holder, and a base, wherein the cover is provided on the lens holder, the cover and the lens holder enclose a space for mounting a lens, the lens holder is arranged on the base, and the base is mountable on a gun; and a light-emitting part is provided on the lens holder and is capable of emitting light to be reflected by the lens to achieve aiming; wherein an end of the top of the cover away from the light-emitting part is configured as a bevel, and a first recessed structure is provided in a middle region of an end of the top of the cover close to the light-emitting part; or a first recessed structure is provided in a middle region above a side surface of the cover close to the light-emitting part; and the first recessed structure extends into the bevel; or the first recessed structure does not extend into the bevel.

In a second aspect, the present disclosure provides a gun, comprising an impact-resistant red dot sight as described above.

List of reference signs: 1. Cover; 2. Lens holder; 3. Base; 4. Lens; 5. Space; 6. Light-emitting part; 7. Bevel; 8. First recessed structure; 9. Second recessed structure; 10. Recess; 11. Corner structure; 12. Third recessed structure.

DETAILED DESCRIPTION OF EMBODIMENTS

Specific embodiments of the present disclosure will be described in detail in this section. Preferred embodiments of the present disclosure are illustrated in the accompanying drawings. The accompanying drawings serve to supplement the text description of the specification with figures, providing a visual understanding of each technical feature and the overall technical solution of the present disclosure, but cannot be construed as a limitation to the scope of protection of the present disclosure.

Since a lens is mounted inside an existing red dot sight, when a gun slips off or is hit in use, the lens inside the red dot sight may be easily damaged after the red dot sight is hit. In addition, during mounting and dismounting the red dot sight, the red dot sight may fall off, and the lens may be broken due to collision of the red dot sight with the ground. In view of the above problems, the embodiments of the present disclosure provide the following solutions to solve one or more of the above problems.

Figure 1:
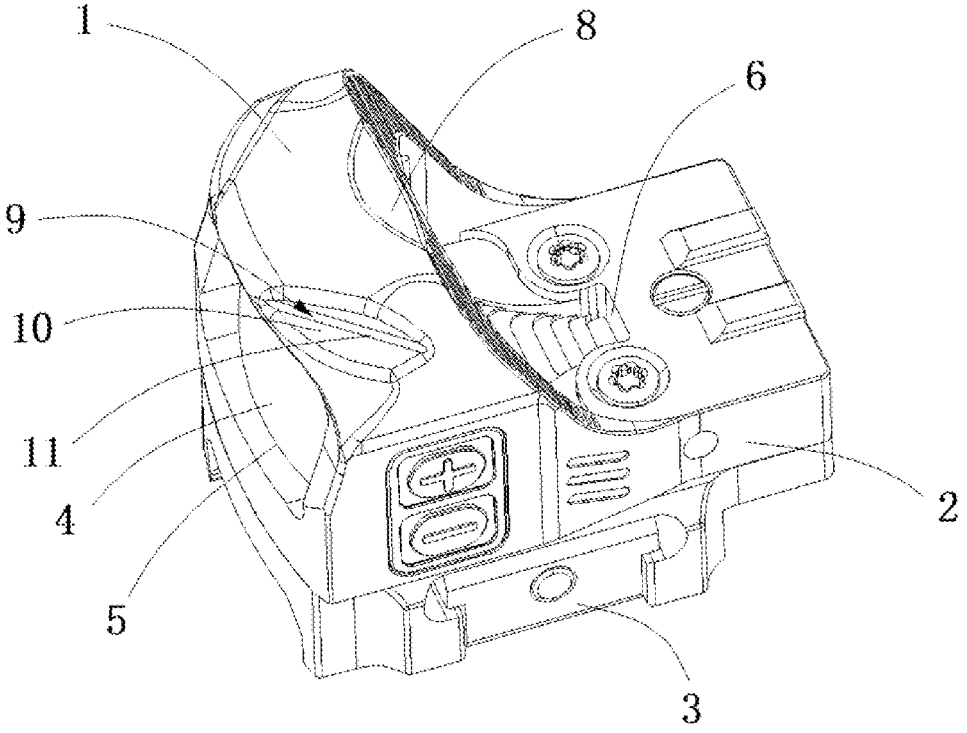
FIG. 1 is a schematic perspective diagram of an impact-resistant red dot sight according to an embodiment of the present disclosure.
Figure 2:
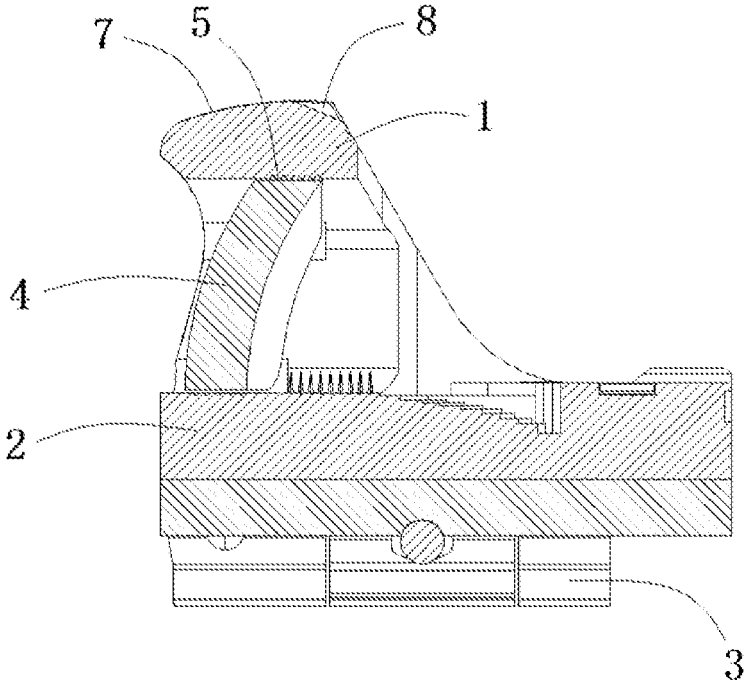
FIG. 2 is a schematic structural diagram of an impact-resistant red dot sight according to an embodiment of the present disclosure.

Referring to FIGS. 1 and 2, in a preferred embodiment of the present disclosure, an impact-resistant red dot sight comprises a cover 1, a lens holder 2, and a base 3, wherein the cover 1 is arranged on the lens holder 2, the cover 1 and the lens holder 2 enclose a space 5 for mounting a lens 4, the lens holder 2 is arranged on the base 3, and the base 3 can be installed on the gun; and a light-emitting part 6 is provided on the lens holder 2 and can emit light to be reflected by the lens 4 to achieve aiming; wherein an end of the top of the cover 1 away from the light-emitting part 6 is configured as a bevel 7, and a first recessed structure 8 is provided in a middle region of an end of the top of the cover 1 close to the light-emitting part 6; and the first recessed structure 8 does not extend into the bevel 7.

In other embodiments, the first recessed structure may be provided in a middle region above a side surface of the cover close to the light-emitting part.

Figure 3:
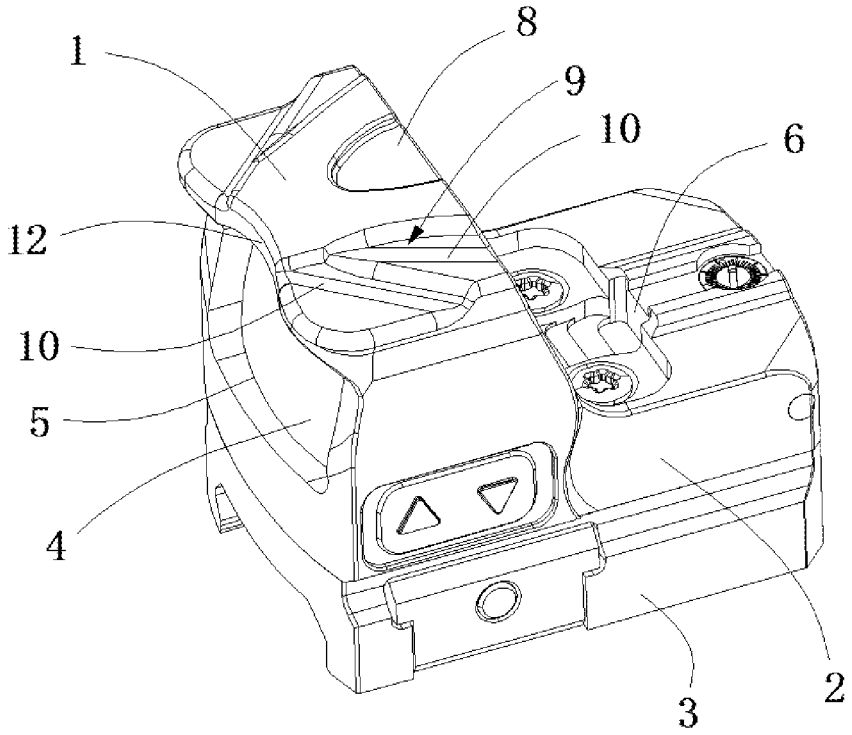
FIG. 3 is a schematic perspective diagram of an impact-resistant red dot sight according to another embodiment of the present disclosure.
Figure 4:
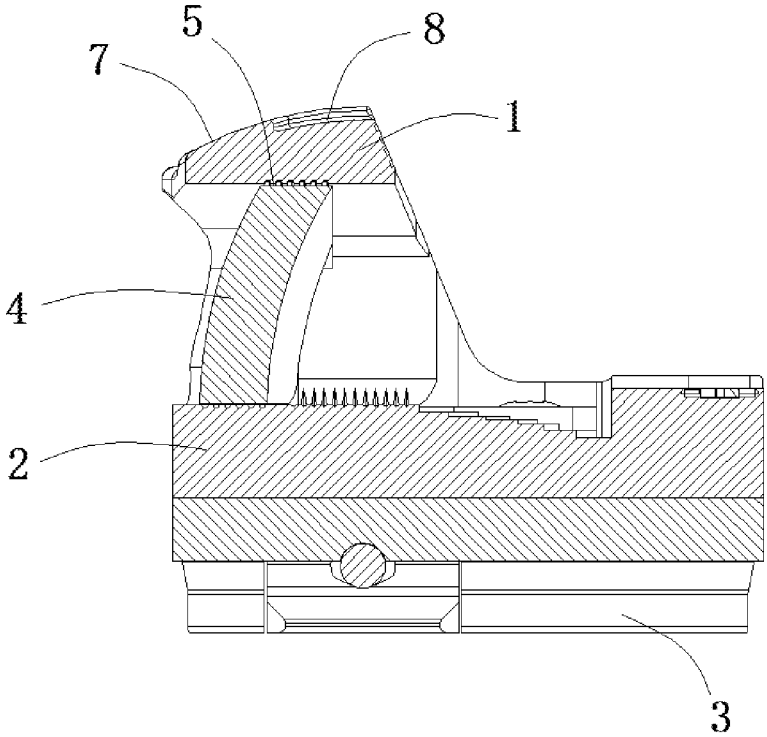
FIG. 4 is a schematic structural diagram of an impact-resistant red dot sight according to another embodiment of the present disclosure.

Referring to FIGS. 3 and 4, in other embodiments, the first recessed structure 8 may extend into the bevel 7.

In the present disclosure, the first recessed structure 8 is not limited with respect to specific shape and may be shaped according to actual requirements. In an optional embodiment, the deepest surface of the first recessed structure may be an angled surface, a surface parallel to the ground, a surface perpendicular to the ground, or a surface of other suitable shapes, which is not limited thereto.

In the present disclosure, the light-emitting part may comprise an LED or other optical elements, which may be provided according to actual requirements and is not limited thereto.

According to the impact-resistant red dot sight of the present disclosure, the end of the top of the cover 1 away from the light-emitting part 6 is configured as the bevel 7 such that part of the bevel 7 is not easily impacted when the impact-resistant red dot sight falls off, the first recessed structure 8 is provided in the middle region of the end of the top of the cover 1 close to the light-emitting part 6 such that the middle region of the top of the cover 1 is not easily impacted, thereby protecting the most vulnerable part of the lens 4. The impact caused when the impact-resistant red dot sight falls off is borne by the two sides of the top of the cover 1, which can lead to effective reduction of the risk of damages to the lens 4 when the impact-resistant red dot sight falls off and to higher safety.

As a preferred embodiment of the present disclosure, the impact-resistant red dot sight may further have the following additional technical features.

In an optional embodiment, a second recessed structure 9 is provided on each of two sides of the top of the cover 1. As such, the second recessed structures 9 are provided such that there are multi-side structures on the two sides of the top of the cover 1. When the impact-resistant red dot sight falls off and the two sides of the top of the cover 1 are impacted, a force acts on several points and the force transmitted to the lens 4 is thus further dispersed, which further reduces the risk of damages to the lens 4 when the impact-resistant red dot sight falls off, and provides higher safety. In other embodiments, no second recessed structures 9 may be provided on the two sides of the top of the cover 1.

In the embodiments of the present disclosure, the specific constructions of the second recessed structures 9 are not limited, and may be configured according to actual requirements. In an optional embodiment, the second recessed structure 9 extends in a front-rear direction of the width of the top of the cover 1 to run through at least an end of the top of the cover 1. As an example, the second recessed structure 9 may extend in the front-rear direction of the width of the top of the cover 1 to run through a front end or a rear end of the top of the cover 1, or the second recessed structure 9 may extend in the front-rear direction of the width of the top of the cover 1 to run through the front end and the rear end of the top of the cover 1. With the above structure, the lens 4 will be better protected, and the safety is higher. In other embodiments, the second recessed structure 9 may extend in the front-rear direction of the width of the top of the cover 1 without running through the top of the cover 1.

Referring to FIG. 3, in an optional embodiment, the second recessed structure 9 comprises at least one recess 10, and the recesses 10 jointly form the stepped second recessed structure 9. As an example, one, two, three, four, five recesses 10 or a different number of recesses 10 may be comprised by the second recessed structure 9. With the above structure, the upper edges and the lower edges of the recesses 10 form the multi-side structures on the two sides of the top of the cover 1 such that the acting force generated when the two sides of the top of the cover 1 are impacted can be well dispersed, the lens 4 is thus better protected, and the safety is higher.

In an optional embodiment, an arc-shaped extended line of the lens 4 extends across the first recessed structure 8. As such, since the lens 4 itself is of an arc-shaped structure, the first recessed structure 8 is arranged on the arc-shaped extended line of the lens 4, the lens 4 can further be protected more effectively and can be prevented from being damaged, and the safety is higher. In other embodiments, the arc-shaped extended line of the lens 4 may partially extends across the first recessed structure 8, the arc-shaped extended line of the lens 4 may not extends across the first recessed structure 8, or the lens 4 may have other suitable shapes, which is not limited thereto.

Referring to FIG. 3, in an optional embodiment, the recesses 10 are misaligned, such that on the one hand, the acting force generated when the two sides of the top of the cover 1 are impacted can further be dispersed more effectively and the lens 4 can be better protected, on the other hand, the cover 1 has a more attractive appearance and the experience of a user is improved. In other embodiments, the recesses 10 may be aligned.

Referring to FIG. 3, in an optional embodiment, the recesses 10 may be different in shape, such that the recesses 10 can be configured to better fit the configuration of the two sides of the top of the cover 1, so as to better disperse the acting force generated when the two sides of the top of the cover 1 are impacted and to better protect the lens 4. In other embodiments, the recesses 10 may be the same in shape.

In the embodiments of the present disclosure, the specific constructions of the recesses 10 are not limited, and may be configured according to actual requirements. Referring to FIG. 1, in an optional embodiment, a corner structure 11 is provided in each recess 10 such that the impact resistance of the two sides of the top of the cover 1 can be increased, and when the impact-resistant red dot sight falls off, the risk of damages to the two sides of the top of the cover 1 can be reduced. In other embodiments, no corner structure 11 may be provided in each recess 10.

In the embodiments of the present disclosure, the specific construction of the corner structure 11 is not limited, and may be configured according to actual requirements. In an optional embodiment, the corner structure 11 extends over the entire length of a corresponding recess 10, such that on the one hand, the impact resistance of the two sides of the top of the cover 1 can be increased more effectively, and on the other hand, it is easier to machine each recess 10, and the machining efficiency is high. In other embodiments, the corner structure 11 may not extend over the entire length of a corresponding recess 10.

Referring to FIG. 1, in an optional embodiment, portions of the two sides of the top of the cover 1 that are not covered by the second recessed structures 9 are arc-shaped. As such, compared with the corner-shaped portions of the two sides of the top of the cover 1 that are not covered by the second recessed structures 9, when the impact-resistant red dot sight falls off, the above structures can prevent an excessively concentrated impact force on the two sides of the top of the cover 1, and the risk of damages to the lens 4 when the impact-resistant red dot sight falls off can be reduced. In other embodiments, the portions of the two sides of the top of the cover 1 that are not covered by the second recessed structures 9 can be configured in the form of a corner, or the portions of the two sides of the top of the cover 1 that are not covered by the second recessed structures 9 can be in other suitable forms, which is not limited thereto.

Referring to FIG. 1, in an optional embodiment, a third recessed structure 12 is provided in the middle region of the end of the top of the cover 1 away from the light-emitting part 6, such that the middle region of the end of the top of the cover 1 away from the light-emitting part 6 is not easily damaged, which further reduces the risk of damages to the lens 4 when the impact-resistant red dot sight falls off and provides higher safety. In other embodiments, no third recessed structure 12 may be provided in the middle region of the end of the top of the cover 1 away from the light-emitting part 6.

Referring to FIGS. 2 and 4, in an optional embodiment, a junction between the end of the top of the cover 1 close to the light-emitting part 6 and the end of the top of the cover 1 away from the light-emitting part 6 is arc-shaped. As such, when the impact-resistant red dot sight falls off, if the junction between the end of the top of the cover 1 close to the light-emitting part 6 and the end of the top of the cover 1 away from the light-emitting part 6 is hit, an impact force acting on the junction between the two ends can be further dispersed, the lens 4 can thus be better protected, the risk of damages to the lens 4 when the impact-resistant red dot sight falls off can be further reduced, and the safety is higher. In other embodiments, the junction between the end of the top of the cover 1 close to the light-emitting part 6 and the top of the cover 1 away from the light-emitting part 6 may be in the form of a corner, or the junction between the end of the top of the cover 1 close to the light-emitting part 6 and the end of the top of the cover 1 away from the light-emitting part 6 may be in other suitable forms, which is not limited thereto.

An embodiment of the present disclosure further provides a gun. The gun comprises an impact-resistant red dot sight mounted on the gun. The impact-resistant red dot sight comprises a cover, a lens holder, and a base, wherein the cover is provided on the lens holder, the cover and the lens holder enclose a space for mounting a lens, the lens holder is arranged on the base, and the base is mountable on a gun; and a light-emitting part is provided on the lens holder and is capable of emitting light to be reflected by the lens to achieve aiming; wherein an end of the top of the cover away from the light-emitting part is configured as a bevel, and a first recessed structure is provided in a middle region of an end of the top of the cover close to the light-emitting part; or a first recessed structure is provided in a middle region above a side surface of the cover close to the light-emitting part; and the first recessed structure extends into the bevel; or the first recessed structure does not extend into the bevel.

Therefore, the gun according to the embodiment of the present disclosure also has the above advantages, that is to say, the risk of damages to the lens 4 when the impact-resistant red dot sight falls off can be reduced effectively, and the safety is higher.

In the embodiment of the present disclosure, the type of the gun is not limited, and the gun may be a pistol, a rifle, or other guns, which is not limited thereto.

Those skilled in the art can freely combine and use the above additional technical features provided that no conflict occurs.

The foregoing implementations are only preferred implementations of the present disclosure and cannot be used to limit the scope of protection of the present disclosure. All non-essential modifications and substitutions made by those skilled in the art on the basis of the present disclosure shall fall within the scope of protection of the present disclosure.

The invention claimed is:

1. An impact-resistant red dot sight, comprising a cover, a lens holder, and a base, wherein the cover is provided on the lens holder, the cover and the lens holder enclose a space for mounting a lens, the lens holder is arranged on the base, and the base is mountable on a gun; and a light-emitting part is provided on the lens holder and is capable of emitting light to be reflected by the lens to achieve aiming;

wherein an end of the top of the cover away from the light-emitting part is configured as a bevel, and a first recessed structure is provided in a middle region of an end of the top of the cover close to the light-emitting part, and the first recessed structure extends into the bevel.

2. The impact-resistant red dot sight according to claim 1, wherein a second recessed structure is provided on each of two sides of the top of the cover.

3. The impact-resistant red dot sight according to claim 2, wherein the second recessed structure extends in a front-rear direction of the width of the top of the cover to at least run through one end of the top of the cover.

4. The impact-resistant red dot sight according to claim 2, wherein the second recessed structure comprises at least two recesses, and the recesses jointly form the stepped second recessed structure.

5. The impact-resistant red dot sight according to claim 4, wherein the recesses are misaligned.

6. The impact-resistant red dot sight according to claim 4, wherein the recesses are shaped differently.

7. The impact-resistant red dot sight according to claim 4, wherein a corner structure is provided in each recess.

8. The impact-resistant red dot sight according to claim 3, wherein portions of the two sides of the top of the cover that are not covered by the second recessed structures are arc-shaped.

9. The impact-resistant red dot sight according to claim 3, wherein a third recessed structure is provided in a middle region of the end of the top of the cover away from the light-emitting part.

10. The impact-resistant red dot sight according to claim 1, wherein a junction between the end of the top of the cover close to the light-emitting part and the end of the top of the cover away from the light-emitting part is arc-shaped.

11. An impact-resistant red dot sight, comprising a cover, a lens holder, and a base, wherein the cover is provided on the lens holder, the cover and the lens holder enclose a space for mounting a lens, the lens holder is arranged on the base, and the base is mountable on a gun; and a light-emitting part is provided on the lens holder and is capable of emitting light to be reflected by the lens to achieve aiming;

wherein an end of the top of the cover away from the light-emitting part is configured as a bevel, and a first recessed structure is provided in a middle region of an end of the top of the cover close to the light-emitting part, and the first recessed structure extends into the bevel.

12. The impact-resistant red dot sight according to claim 11, wherein a second recessed structure is provided on each of two sides of the top of the cover.

13. The impact-resistant red dot sight according to claim 12, wherein the second recessed structure extends in a front-rear direction of the width of the top of the cover to at least run through one end of the top of the cover.

14. The impact-resistant red dot sight according to claim 12, wherein the second recessed structure comprises at least two recess, and the recesses jointly form the stepped second recessed structure.

15. The impact-resistant red dot sight according to claim 14, wherein the recesses are misaligned.

16. The impact-resistant red dot sight according to claim 14, wherein the recesses are shaped differently.

17. The impact-resistant red dot sight according to claim 14, wherein a corner structure is provided in each recess.

18. A gun, comprising an impact-resistant red dot sight mounted on the gun, the impact-resistant red dot sight comprising a cover, a lens holder, and a base, wherein the cover is provided on the lens holder, the cover and the lens holder enclose a space for mounting a lens, the lens holder is arranged on the base, and the base is mountable on a gun; and a light-emitting part is provided on the lens holder and is capable of emitting light to be reflected by the lens to achieve aiming;

wherein an end of the top of the cover away from the light-emitting part is configured as a bevel, and a first recessed structure is provided in a middle region of an end of the top of the cover close to the light-emitting part, and the first recessed structure extends into the bevel.

* * * * *